US009205018B2

(12) United States Patent
Hinkle

(10) Patent No.: US 9,205,018 B2
(45) Date of Patent: Dec. 8, 2015

(54) FOLDING TRANSFER HANDLE

(71) Applicant: Nicholas Hinkle, Wooster, OH (US)

(72) Inventor: Nicholas Hinkle, Wooster, OH (US)

( * ) Notice: Subject to any disclaimer, the term of this patent is extended or adjusted under 35 U.S.C. 154(b) by 0 days.

(21) Appl. No.: 13/903,566

(22) Filed: May 28, 2013

(65) Prior Publication Data

US 2013/0326845 A1 Dec. 12, 2013

Related U.S. Application Data

(60) Provisional application No. 61/656,695, filed on Jun. 7, 2012.

(51) Int. Cl.
*A61H 3/00* (2006.01)

(52) U.S. Cl.
CPC ..... *A61H 3/00* (2013.01); *A61H 2003/001* (2013.01); *A61H 2201/0161* (2013.01); *Y10T 16/473* (2015.01)

(58) Field of Classification Search
CPC ..... B25G 1/04; B25G 1/10; B25G 3/38; E05D 11/06; A47K 3/003; A47K 17/024; A61G 7/053; Y10T 16/44; Y10T 16/473; Y10T 16/48; Y10T 16/498; Y10T 16/50; Y10T 16/551; Y10S 16/24; A61H 3/00; A61H 2003/001; A61H 2201/0161
USPC ..... 16/110.1, 429, 431, 436, 438, DIG. 24, 16/374; 4/254, 576.1, 577.1, 611; 5/662
See application file for complete search history.

(56) References Cited

U.S. PATENT DOCUMENTS

| | | | | |
|---|---|---|---|---|
| 2,059,171 | A | 10/1936 | Harris | |
| 4,908,906 | A | 3/1990 | Hanna | |
| 5,590,440 | A | 1/1997 | Pelt et al. | |
| 6,276,027 | B1 | 8/2001 | Hanna | |
| 6,709,125 | B2 * | 3/2004 | Jarvis | 362/84 |
| 6,986,177 | B2 | 1/2006 | Thaxton | |
| D596,278 | S | 7/2009 | Stimpson et al. | |
| 2004/0256866 | A1 | 12/2004 | Deming, Jr. | |
| 2007/0137404 | A1 | 6/2007 | Bertani | |
| 2011/0084578 | A1 | 4/2011 | Newkirk et al. | |

FOREIGN PATENT DOCUMENTS

| | | |
|---|---|---|
| EP | 2305198 | 4/2011 |
| GB | 484446 | 5/1938 |

* cited by examiner

*Primary Examiner* — William Miller
(74) *Attorney, Agent, or Firm* — Dominic A. Frisina

(57) ABSTRACT

Embodiments may comprise a folding transfer handle having a mounting bracket. A mounting bracket may include a base wall adapted to engage an arbitrary surface in a fixed mounting relation. Embodiments may further include a handle member such as a bar having a free end, and a pivot end. The length of the handle member may be approximately equal to the width of the palm of an adult human hand. The pivot end of the handle member may include a means for engaging the mounting bracket in a pivotal relation defining a 90 degree range of motion between a deployed configuration and a stowed configuration.

20 Claims, 8 Drawing Sheets

FOLDING TRANSFER HANDLE

This application claims priority to U.S. provisional patent application No. 61/656,695 filed on Jun. 7, 2012, which is incorporated herein by reference in its entirety.

I. BACKGROUND OF THE INVENTION

A. Field of Invention

Embodiments may generally relate to devices for assisting elderly and/or disabled persons to ambulate.

B. Description of the Related Art

Various devices for assisting elderly and disabled persons in moving about are known in the art. However, known devices have a number of shortcomings. For example, some devices are only suitable for being pulled, which is not helpful for an individual ascending stairs or stepping up through an elevated doorway in part because they would need to be inconveniently positioned in front of the user. Furthermore, a disabled or elderly person may not have suitable upper body strength and/or shoulder joint health to effectively use a pull-type device. Thus, a device designed to bear a vertical load rather than a tension load would be preferable. Devices for bearing vertical loads are known; however, existing devices are not suitable for use in doorways and stairwells because they tend to obstruct walkways.

Furthermore, in a darkened or low-light environment existing devices may be difficult to see and users may have difficulty finding the device and/or may tend to inadvertently bump into the device causing injury. Elderly individuals and people suffering from diseases such as diabetes may have an impaired ability to heal such injuries, thus elevating the importance of a device which is unobstructive and easy to see.

What is needed is a device which is able to bear vertical loads while not impeding a person's ability to walk. Some embodiments of the present invention may provide one or more benefits or advantages over the prior art.

II. SUMMARY OF THE INVENTION

Some embodiments may relate to a folding transfer handle, comprising: a mounting bracket having a base wall adapted to engage an arbitrary surface in a fixed mounting relation; and a handle member comprising a free end, and a pivot end spaced apart from the free end by a length approximately equal to the width of the palm of an adult human hand, wherein the pivot end of the handle member includes a means for engaging the mounting bracket in a pivotal relation defining a 90 degree range of motion between a deployed configuration and a stowed configuration.

According to some embodiments the handle member comprises a grip adapted to be grasped by a human hand, and a linkage portion extending coaxially from an end of the grip distal to the free end of the handle member, the linkage portion being no longer than necessary to engage the mounting bracket in the pivotal relation.

According to some embodiments the mounting bracket further comprises at least one bearing wall extending perpendicularly from an edge of the base wall.

According to some embodiments the at least one bearing wall includes a means for cooperatively engaging the handle member's means for engaging the mounting bracket in the pivotal relation.

According to some embodiments the means of the at least one bearing wall for cooperatively engaging comprises a bearing adapted to receive a journal, the bearing being selected from one or more of a plain bearing, a ball bearing, or a roller bearing.

According to some embodiments the plain bearing comprises a through-hole for receiving the journal therethrough.

According to some embodiments the pivot end of the handle member comprises a first mechanical stop defining an end of the 90 degree range of motion comprising the deployed configuration.

According to some embodiments the first mechanical stop comprises a remaining portion of the pivot end of the handle member after removing sufficient material from one half of the pivot end to allow the handle member to rotate through the 90 degree range of motion about a bearing.

According to some embodiments the mounting bracket comprises a second mechanical stop defining an end of the 90 degree range of motion comprising the stowed configuration, the handle member being adapted to contact the mounting bracket in the stowed configuration.

According to some embodiments the grip is so dimensioned as to contact the mounting bracket in the stowed configuration, the grip being comprised of a pliable material.

Some embodiments may relate to a folding transfer handle, comprising: a mounting bracket having a base wall adapted to engage an arbitrary surface in a fixed mounting relation, wherein the mounting bracket further comprises at least one bearing wall extending perpendicularly from an edge of the base wall; and a handle member comprising a free end, and a pivot end spaced apart from the free end by a length approximately equal to the width of the palm of an adult human hand, wherein the pivot end of the handle member includes a means for engaging the mounting bracket in a pivotal relation defining a 90 degree range of motion between a deployed configuration and a stowed configuration, and wherein the at least one bearing wall includes a means for cooperatively engaging the handle member's means for engaging the mounting bracket in the pivotal relation.

According to some embodiments the at least one bearing wall includes at least one aperture permitting a fastener to pass therethrough and cooperatively engage the arbitrary surface in a mounting relation.

According to some embodiment a folding transfer handle may further comprise at least one glow strip disposed on the mounting bracket, and/or the handle member Some embodiments may relate to a folding transfer handle, comprising: a mounting bracket having a base wall adapted to engage an arbitrary surface in a fixed mounting relation, wherein the mounting bracket includes at least one bearing wall extending perpendicularly from an edge of the base wall, and wherein the at least one bearing wall includes at least one aperture permitting a fastener to pass therethrough and cooperatively engage the arbitrary surface in a mounting relation; and a handle member comprising a bar having a free end, and a pivot end spaced apart from the free end by a length approximately equal to the width of the palm of an adult human hand, wherein the pivot end of the handle member includes a means for engaging the mounting bracket in a pivotal relation defining a 90 degree range of motion between a deployed configuration and a stowed configuration, wherein the at least one bearing wall includes a means for cooperatively engaging the handle member's means for engaging the mounting bracket in the pivotal relation, and wherein the handle member comprises a grip adapted to be grasped by a human hand, and a linkage portion extending coaxially from the end of the grip distal to the free end of the handle member, the linkage portion being no longer than necessary to engage the mounting bracket in the pivotal relation.

Other benefits and advantages will become apparent to those skilled in the art to which it pertains upon reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION OF THE INVENTION

Figure 1:
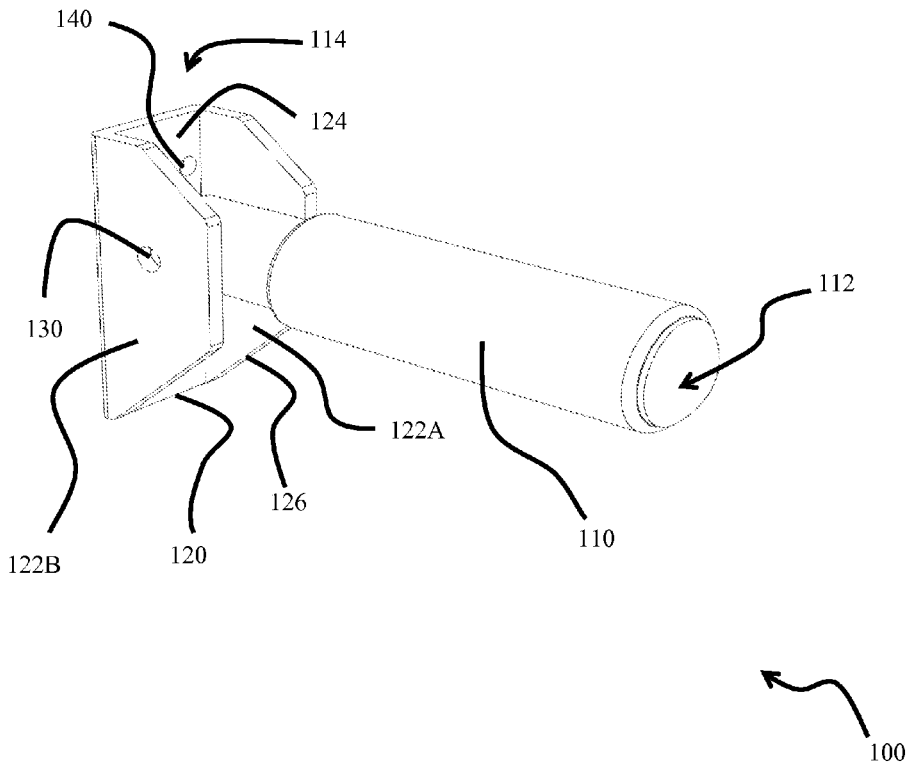
FIG. 1 is a perspective view of an embodiment.

Some embodiments of the invention may relate to a folding handle for supporting the body weight, or some portion thereof, of an individual. More particularly, an embodiment may include a mounting bracket for mounting the device to an appropriate substrate, and a handle which may pivot in relation to the mounting bracket. This pivoting action may allow the device to be quickly switched between stowed and deployed configurations. Furthermore, embodiments may be specially dimensioned to fit between the entrance door of a dwelling and a storm door, and/or to be about the thickness of a typical household wall stud i.e. about 1.5 inches.

A mounting bracket may take many forms, but in general will include a base wall adapted to engage an arbitrary surface in a fixed mounting relation. A base wall may be generally flat and may include a plurality of through holes for receiving fasteners such as screws. A mounting bracket may further comprise one or more bearing walls extending from, for example, an edge of the mounting bracket. For instance, when the mounting bracket is in an installed orientation it may have left and right edges. Thus, a bearing wall may extend from one or more of the left or right edges, and away from the surface on which the mounting bracket is installed. In one embodiment, the one or more bearing walls may extend perpendicularly away from the base wall; however, oblique bearing walls may also be suitable.

While the one or more bearing walls may extend from left or right edges of the base wall or from a center of the base wall, one or more bearing walls may be inset from the edges of the base wall thus leaving a flange. One or more through holes may be formed in such a flange to receive fasteners for mounting the bracket to an arbitrary surface. In another embodiment, a bearing wall may include one or more through holes adapted to receive a fastener, wherein the fastener cooperatively engages an underlying mounting surface such as a wall or door jamb and fastens the bracket thereto. According to such embodiments the bearing wall(s) would generally be thickened sufficiently to accept a suitably large fastener for mounting the bracket.

Suitable surfaces for mounting may vary widely. In general, such a surface should be strong enough to support a portion of the body weight of an individual when a user leans on an installed embodiment. Suitable surfaces may include materials typically used for building walls and door jambs in residential housing and commercial buildings. For instance, such materials may include, without limitation, drywall, wood paneling, wooden wall studs, and wooden or metal door jambs. In general, embodiments and the substrates to which they are mounted should be adapted to withstand a minimum of about 200 to 250 lbs.

The handle member of an embodiment also take many forms; however, a suitable handle member may comprise a length approximately equal to the width of an adult human hand. More specifically, suitable lengths may be from about 4 to 5 inches, 5 to 6 inches, 6 to 7 inches, or 7 to 8 inches. Here as elsewhere in the specification and claims, ranges may be combined. A handle member may include a free end and a pivot end. The pivot end may include means for engaging the mounting bracket in a pivotal relation. Furthermore, a handle member may include a grip portion and a linkage portion. The grip portion may have a length approximately equal to the width of an adult human hand. The linkage portion may be an additional length extending from the end of the grip distal from the free end of the handle. Thus, the linkage portion may form the pivot end of the handle member, and may include means for pivotally engaging the mounting bracket.

According to embodiments of the invention, a mounting bracket and a handle member are in a pivotal relation to each other. Such a pivotal relation may be achieved through a number of different means provided that said means allow the handle member to be placed in a deployed configuration which is generally horizontal, and a stowed configuration which is generally vertical. Thus, the handle member may have a single rotational axis and a 90 degree range of motion about said axis.

In some embodiments the pivotal relation described above may be achieved using a journal bearing cooperatively engaging one or more bearing walls of the mounting bracket and the linkage of the handle member. For instance, the one or more side walls may have a through hole for receiving a journal therethrough, and the linkage may have a complimentary through hole for cooperatively receiving the same journal. Other embodiments may include ball bearings or roller bearings rather than journal bearings.

Embodiments which achieve the pivotal relation described herein using bearings formed in the bearing wall(s) and linkage may require mechanical stops at either end of the 90 degree range of motion. For instance, a handle member would continue to extend downward from horizontal unless a mechanical stop is provided. Thus, one such stop may comprise rounding off one half of the pivot end of the handle member. Accordingly, by mounting the handle to the mounting bracket so that the pivot end touches the base wall the rounded portion allows the handle to rotate about a journal bearing while the non-rounded portion thereof forms a mechanical stop. One skilled in the art will appreciate that a bevel may be used in place of rounding to obtain the same effect.

Embodiments may include an alternative mechanical stop formed by adding a lower wall to the mounting bracket. The lower wall would catch the handle member at the deployed end of its range of motion and would act as a support for the handle member. Thus, such a mechanical stop would be capable of bearing the entire load of a user.

The second mechanical stop at the stowed end of the handle member's range of motion can comprise the mounting bracket itself. For instance, as the handle member is moved to the stowed configuration the handle member may touch the mounting bracket or the underlying mounting surface which would prevent further motion. Some embodiments may also include means for retaining the handle member in the stowed relation. For instance, the handle member may be biased toward the stowed configuration by a spring or hydraulic cylinder. Thus, a user deploys the handle by grasping it while stowed and applying a downward force; however, when the user releases the handle member it would be pulled back into the stowed configuration by a hydraulic cylinder or other biasing means.

Referring now to the drawings wherein the showings are for purposes of illustrating embodiments of the invention only and not for purposes of limiting the same, FIG. 1 is a perspective view of an embodiment 100. The embodiment 100 is shown in a partially deployed configuration wherein the handle member 110 is between the ends of its range of motion. The handle member 110 has a free end 112 and a pivot end 114. The pivot end 114 of the handle member 110 is pivotally engaged with a mounting bracket 120 through a journal bearing 130.

The mounting bracket 120 shown in FIG. 1 includes a base wall 124 which is flat in this embodiment 100. A pair of bearing walls 122A and 122B are shown extending perpendicularly from left and right edges of the base wall 124. The bearing walls 122A, 122B include a bevel 126 which provides additional clearance to prevent a user from bumping into the mounting bracket 120 while climbing stairs, for instance. Also shown in FIG. 1 is one of a plurality of through holes 140 in the base wall 120 which are adapted to receive fasteners for mounting the embodiment 100 to an arbitrary surface such as a wall or door jamb. Due to the fact that embodiments are to be used in stairwells and doorways where space is limited, when the embodiment is in a stowed relation, the total distance that the embodiment extends from the surface to which it is mounted is defined by the mounting bracket 120. Thus, the handle member 110 does not contribute to this distance when in a fully stowed configuration.

Figure 2B:
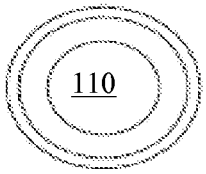
FIG. 2B is a cross sectional view of the handle member of FIG. 2A.
Figure 2A:
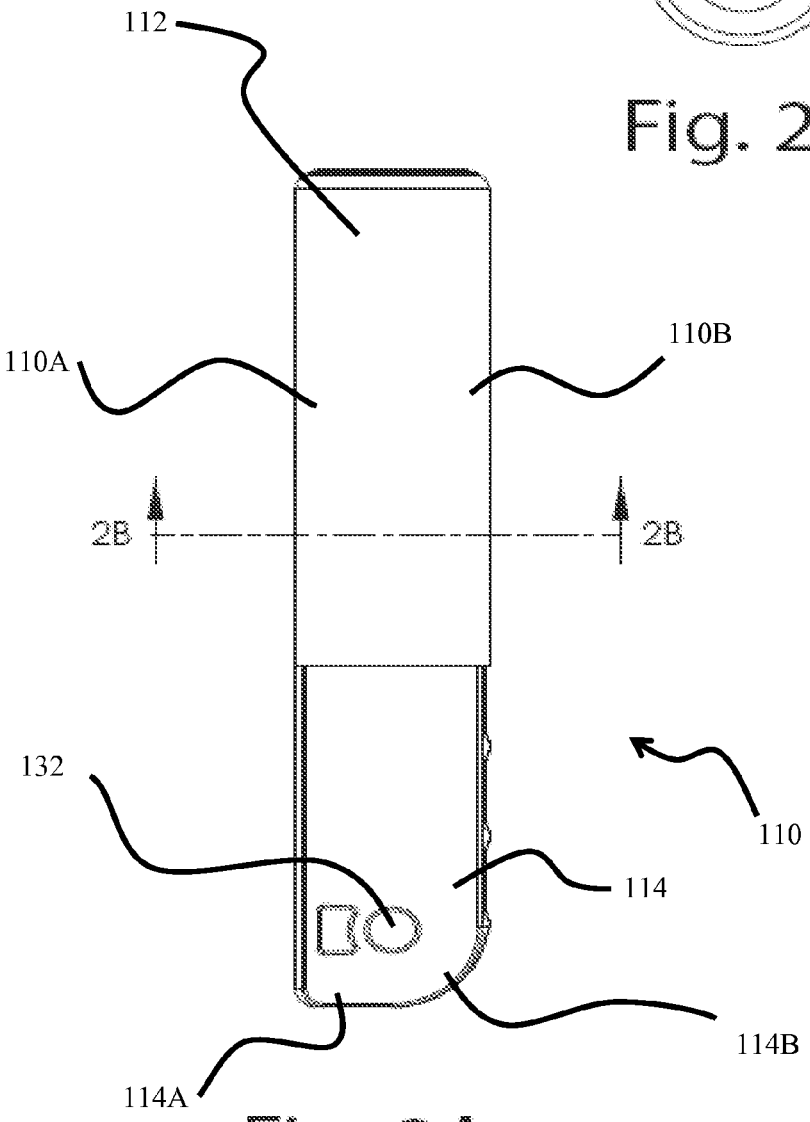
FIG. 2A is a plan view of a handle member of an embodiment.

FIG. 2A is a plan view of a handle member 110 showing the free end 112 and the pivot end 114. This is a simplified version of the handle member 110 which lacks a specific grip member. The pivot end 114 includes a through hole 132 for receiving a journal in cooperation with the mounting bracket 120. An axis is shown bisecting the handle member 110 lengthwise into two halves 110A, 110B. The portion of the pivot end 114 within 110A has a square edge 114A, while the portion of the pivot end 114 within 110B has a rounded edge 114B. The handle member 110 can be mounted so that the square edge of the pivot end 114 can be very close to or abutting the base wall 124 of the mounting bracket 120 when the handle member 110 is in a fully deployed configuration. Thus, the square edge 114A functions as a mechanical stop defining one end of the handle member's 110 range of motion. The rounded edge 114B allows the handle member 110 to rotate about the journal bearing 130 between the ends of its range of motion. One skilled in the art will appreciate that a bevel may be substituted for the rounded edge 114B.

FIG. 2B is a cross sectional view of the handle member 110 taken along line 2B-2B. This particular handle member 110 has a circular cross section; however, one skilled in the art will appreciate that the invention is not limited in this way. The view of FIG. 2B is merely provided to better illustrate the three dimensional contour of the pivot end.

Figure 3:
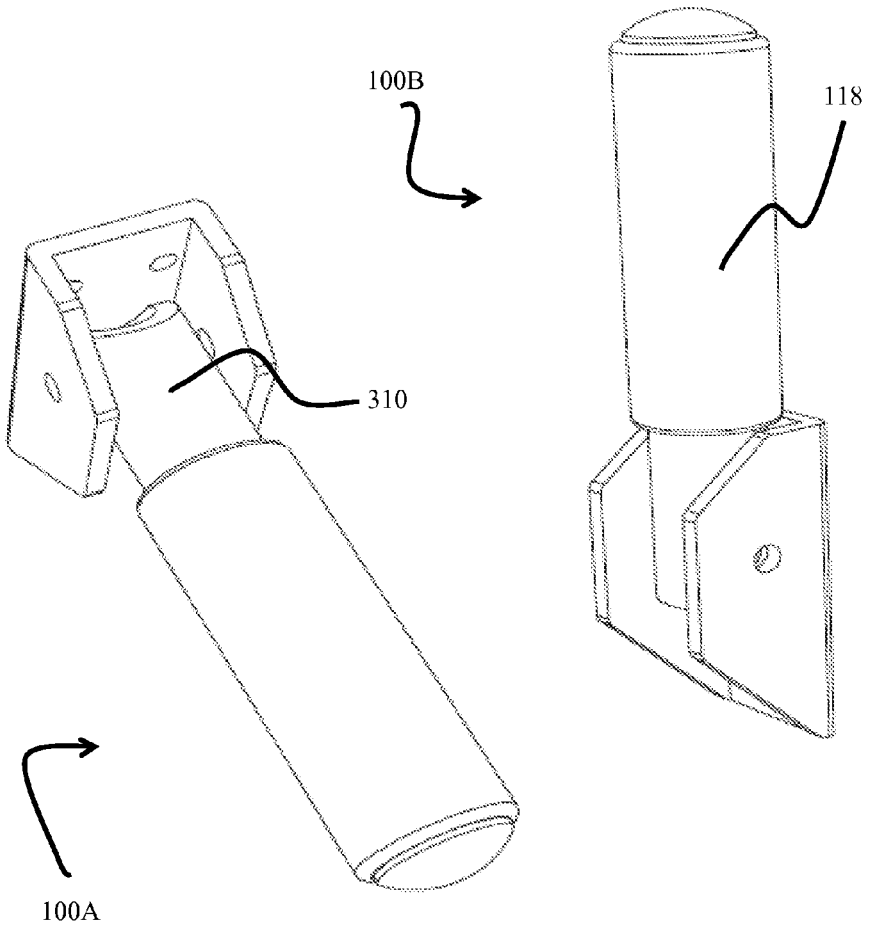
FIG. 3 is a pair of views showing the deployed and stowed configurations.

FIG. 3 illustrates a version of the embodiment of FIG. 1 having a grip portion 118 made from a pliable foam rubber. The embodiment is shown in a deployed configuration 100A and a stowed configuration 100B. A linkage portion 310 is shown extending coaxially with the grip portion 118. The linkage portion 310 is only long enough to permit the handle member 110 to rotate without the grip portion 118 touching the mounting bracket 120 at least until the handle reaches its stowed configuration.

Figure 4:
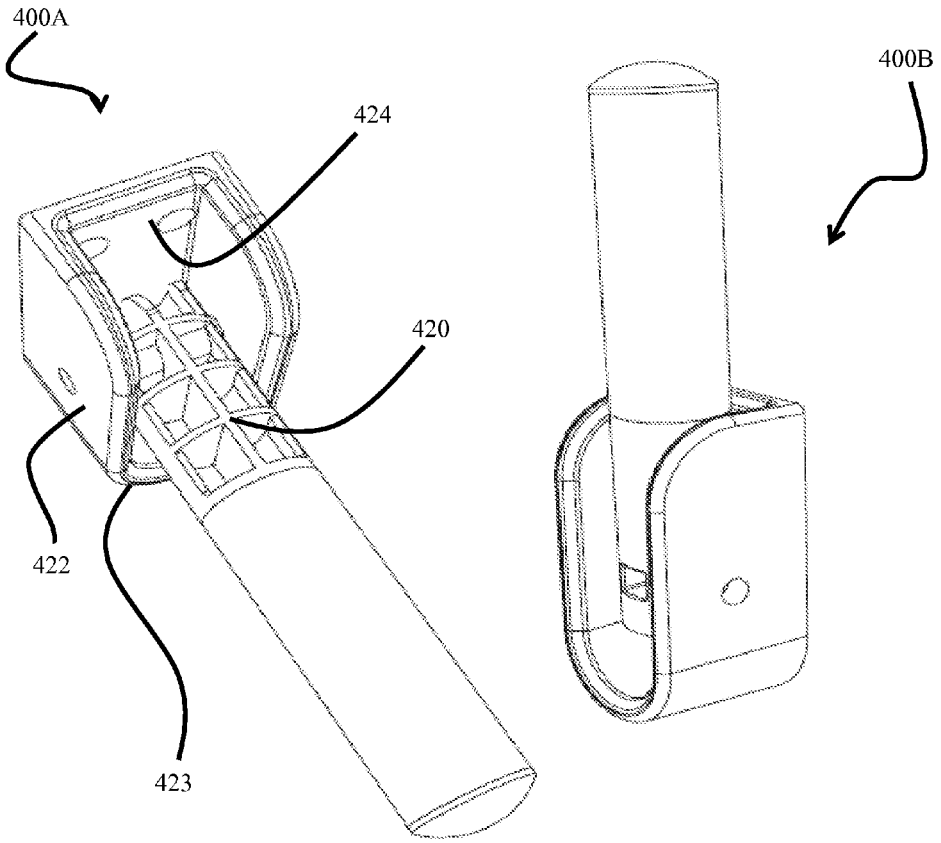
FIG. 4 is an embodiment shown in deployed and stowed configurations.

FIG. 4 shows an embodiment in a deployed configuration 400A and a stowed configuration 400B. In this embodiment the bearing walls 122A and 122B are replaced with a single continuous wall 422 which wraps around the perimeter of a base wall 424. Such embodiments may provide vertical support to the handle member 110 by providing a wall section 423 which the handle member 110 may abut. According to some embodiments, a wall section 423 may serve as a mechanical stop defining the deployed end of the handle member's 110 range of motion. Also visible in FIG. 4 is a plurality of hollow portions 420 formed in the linkage of the handle member. Forming the handle member in this way may reduce the amount of material required to make an embodiment which maintaining sufficient strength.

Figure 5A:
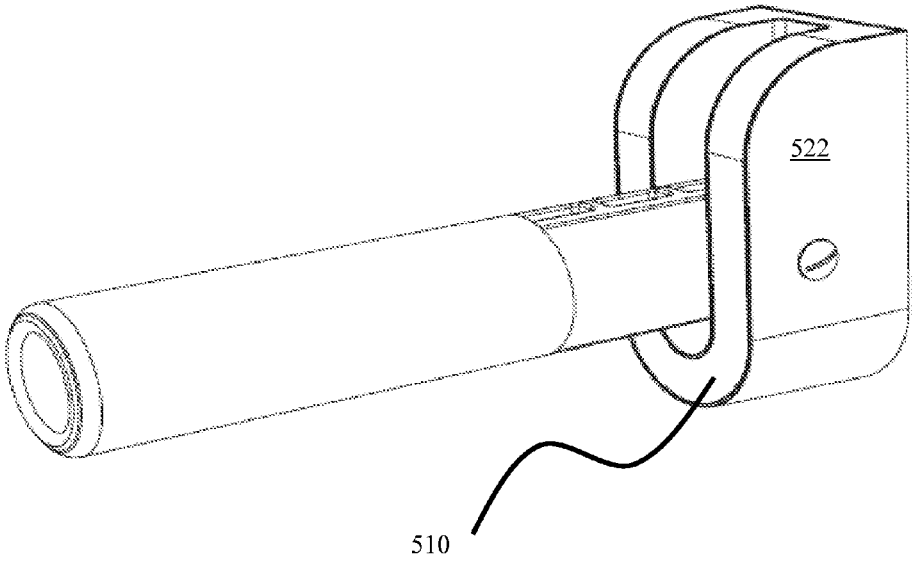
FIG. 5A is an embodiment shown in a deployed configuration.
Figure 5B:
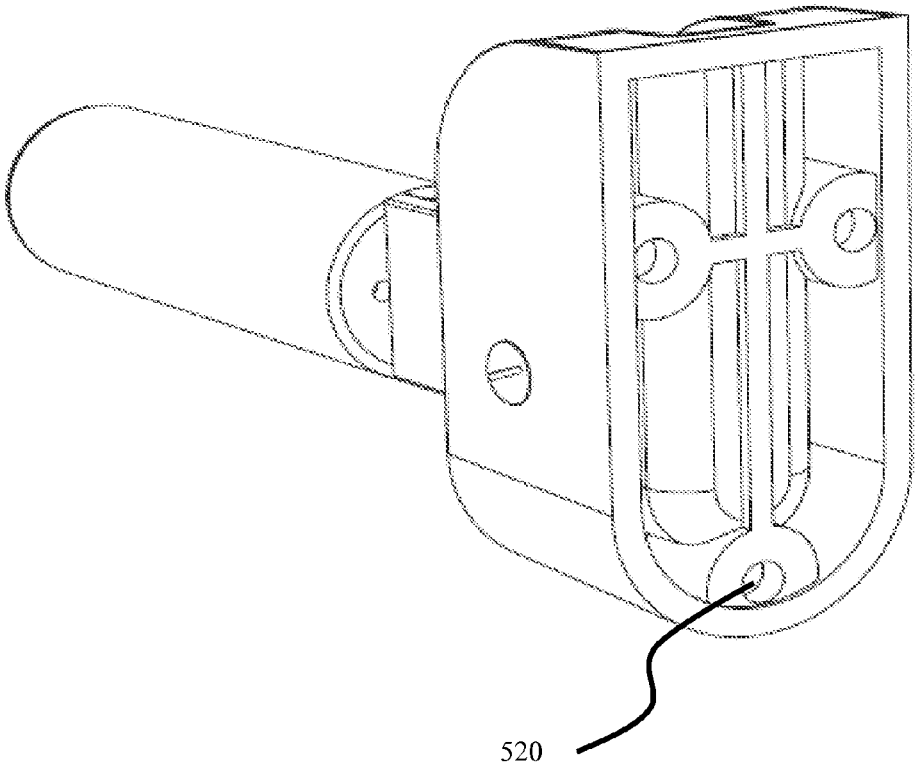
FIG. 5B is a rear view of an embodiment.
Figure 5C:
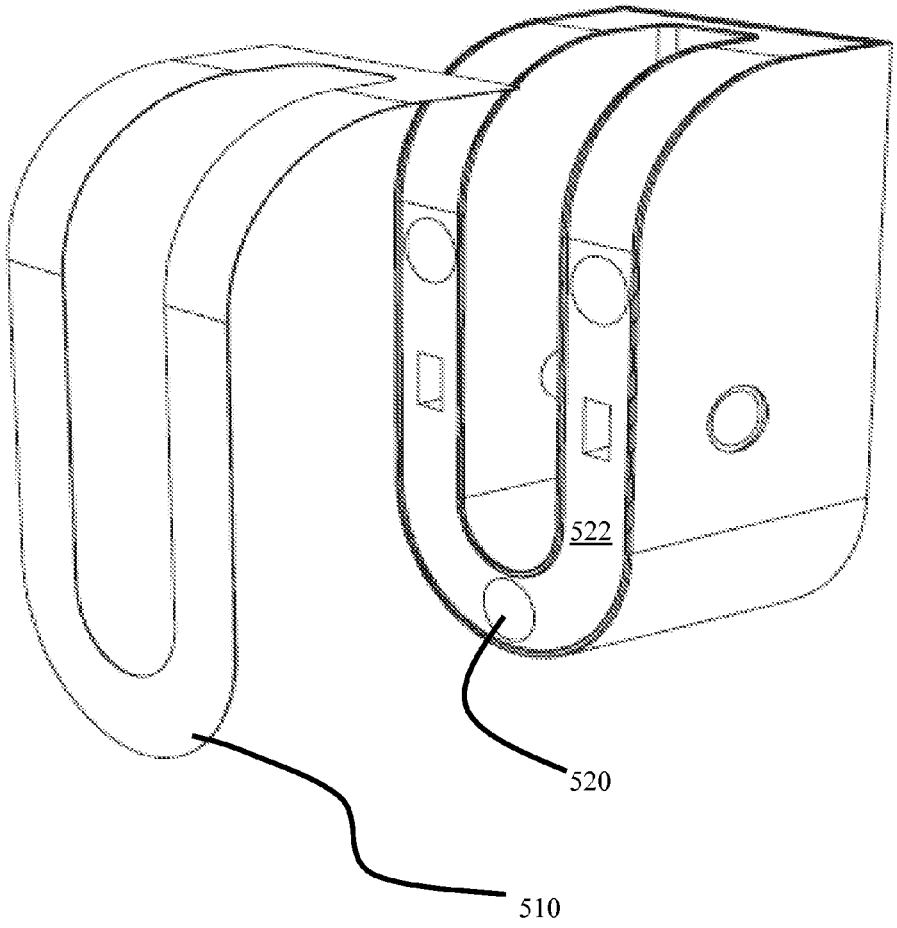
FIG. 5C is a mounting bracket of an embodiment.

FIGS. 5A, 5B and 5C illustrate an embodiment having thickened bearing walls 522 which include apertures or through holes 520 adapted to receive fasteners for mounting the embodiment to an arbitrary substrate. The rear view of FIG. 5B illustrates the placement of these through holes 520 in the base wall, and the front view of FIG. 5C shows the through holes 520 hidden beneath a glow strip 510. A glow strip may provide users with an enhanced ability to find the device or avoid bumping into the device in low light areas.

Figure 6:
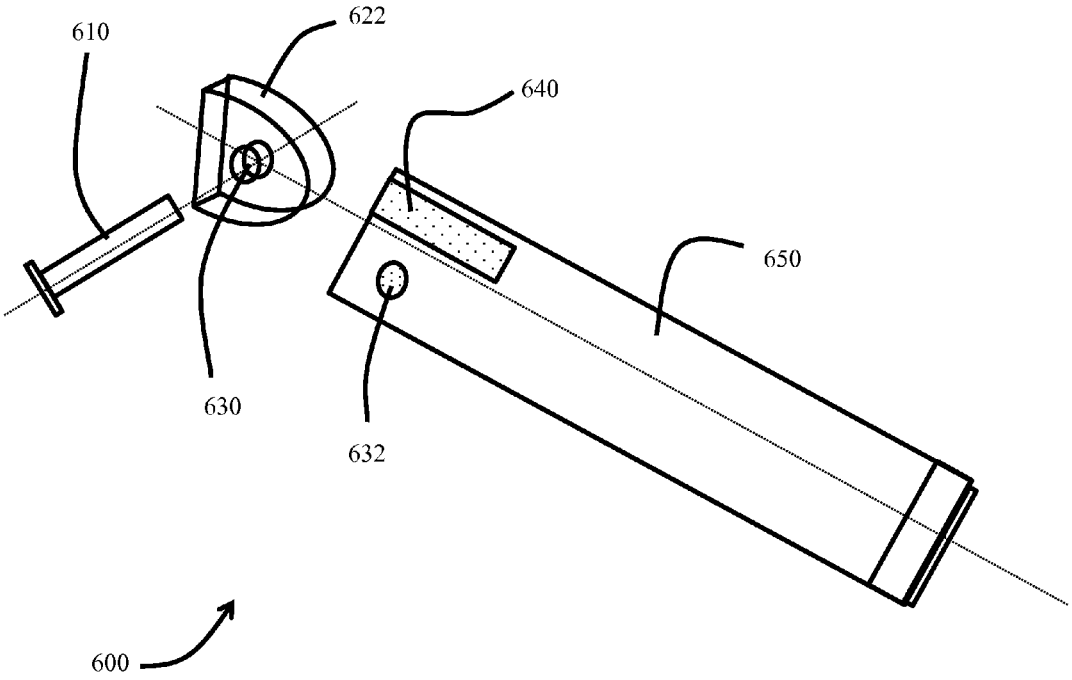
FIG. 6 is an exploded view of an embodiment having a handle member with a split pivot end.

FIG. 6 illustrates an embodiment 600 where the handle member 650 has a split pivot end 640. The split pivot end 640 is thus adapted to receive a bearing 622 in a pivotable relation. Both the split pivot end 640 and the bearing 622 include through holes 630 and 632 respectively for receiving a journal 610 about which the handle member 650 may pivot. Although not shown, such an embodiment 650 would additionally include a mechanical stop for holding the handle member 650 in a deployed configuration.

It will be apparent to those skilled in the art that the above methods and apparatuses may be changed or modified without departing from the general scope of the invention. The invention is intended to include all such modifications and alterations insofar as they come within the scope of the appended claims or the equivalents thereof.

I claim:

1. A folding transfer handle, comprising:

a mounting bracket having a base wall adapted to engage an arbitrary surface in a fixed mounting relation; and a handle member comprising a free end, and a pivot end spaced apart from the free end by a length approximately equal to the width of the palm of an adult human hand, wherein the pivot end of the handle member includes a means for engaging the mounting bracket in a pivotal relation defining a 90 degree range of motion between a deployed configuration and a stowed configuration.

2. The folding transfer handle according to claim 1, wherein the handle member comprises a grip adapted to be grasped by a human hand, and a linkage portion extending coaxially from an end of the grip distal to the free end of the handle member, the linkage portion being no longer than necessary to engage the mounting bracket in the pivotal relation.

3. The folding transfer handle of claim 2, wherein the means for engaging the mounting bracket in a pivotal relation defining a 90 degree range of motion comprises the mounting bracket including a mechanical stop defining an end of the 90 degree range of motion comprising the stowed configuration, the handle member being adapted to contact the mounting bracket in the stowed configuration.

4. The folding transfer handle of claim 3, wherein the grip is so dimensioned as to contact the mounting bracket in the stowed configuration, the grip being comprised of a pliable material.

5. The folding transfer handle according to claim 1, wherein the mounting bracket further comprises at least one bearing wall extending perpendicularly from an edge of the base wall.

6. The folding transfer handle according to claim 5, wherein the at least one bearing wall includes a means for cooperatively engaging the handle member's means for engaging the mounting bracket in the pivotal relation.

7. The folding transfer handle according to claim 6, wherein the means of the at least one bearing wall for cooperatively engaging comprises a bearing adapted to receive a journal, the bearing being selected from one or more of a plain bearing, a ball bearing, or a roller bearing.

8. The folding transfer handle of claim 7, wherein the plain bearing comprises a through-hole for receiving the journal therethrough.

9. The folding transfer handle of claim 1, wherein the means for engaging the mounting bracket in a pivotal relation defining a 90 degree range of motion comprises a first mechanical stop defining an end of the 90 degree range of motion comprising the deployed configuration.

10. The folding transfer handle of claim 9, wherein one half of the pivot end of the handle member comprises a vertex defining the first mechanical stop and another half of the pivot end of the handle member is rounded allowing the handle member to rotate through the 90 degree range of motion about a bearing.

11. A folding transfer handle, comprising:

a mounting bracket having a base wall adapted to engage an arbitrary surface in a fixed mounting relation, wherein the mounting bracket further comprises at least one bearing wall extending perpendicularly from an edge of the base wall; and a handle member comprising a free end, and a pivot end spaced apart from the free end by a length approximately equal to the width of the palm of an adult human hand, wherein the pivot end of the handle member includes a means for engaging the mounting bracket in a pivotal relation defining a 90 degree range of motion between a deployed configuration and a stowed configuration, and wherein the at least one bearing wall includes a means for cooperatively engaging the handle member's means for engaging the mounting bracket in the pivotal relation.

12. The folding transfer handle according to claim 11, wherein the handle member comprises a grip adapted to be grasped by a human hand, and a linkage portion extending coaxially from the end of the grip distal to the free end of the handle member, the linkage portion being no longer than necessary to engage the mounting bracket in the pivotal relation.

13. The folding transfer handle according to claim 11, wherein the means of the at least one bearing wall for cooperatively engaging comprises a bearing adapted to receive a journal, the bearing being selected from one or more of a plain bearing, a ball bearing, or a roller bearing.

14. The folding transfer handle of claim 13, wherein the plain bearing comprises a through-hole for receiving the journal therethrough.

15. The folding transfer handle of claim 11, wherein the means for engaging the mounting bracket in a pivotal relation defining a 90 degree range of motion comprises a first mechanical stop defining an end of the 90 degree range of motion comprising the deployed configuration.

16. The folding transfer handle of claim 15, wherein one half of the pivot end of the handle member comprises a vertex defining the first mechanical stop and another half of the pivot end of the handle member is rounded allowing the handle member to rotate through the 90 degree range of motion about a bearing.

17. The folding transfer handle of claim 11, wherein the means for engaging the mounting bracket in a pivotal relation defining a 90 degree range of motion comprises the mounting bracket including a mechanical stop defining an end of the 90 degree range of motion comprising the stowed configuration, the handle member being adapted to contact the mounting bracket in the stowed configuration.

18. The folding transfer handle of claim 11, further comprising at least one glow strip disposed on the mounting bracket, and/or the handle member.

19. The folding transfer handle of claim 11, wherein the at least one bearing wall includes at least one through hole permitting a fastener to pass therethrough and cooperatively engage the arbitrary surface in a mounting relation.

20. A folding transfer handle, comprising:

a mounting bracket having a base wall adapted to engage an arbitrary surface in a fixed mounting relation, wherein the mounting bracket includes at least one bearing wall extending perpendicularly from an edge of the base wall, and wherein the at least one bearing wall includes at least one through hole permitting a fastener to pass therethrough and cooperatively engage the arbitrary surface in a mounting relation; and a handle member comprising a bar having a free end, and a pivot end spaced apart from the free end by a length approximately equal to the width of the palm of an adult human hand, wherein the pivot end of the handle member includes a means for engaging the mounting bracket in a pivotal relation defining a 90 degree range of motion between a deployed configuration and a stowed configuration, wherein the at least one bearing wall includes a means for cooperatively engaging the handle member's means for engaging the mounting bracket in the pivotal relation, and wherein the handle member comprises a grip adapted to be grasped by a human hand, and a linkage portion extending coaxially from the end of the grip distal to the free end of the handle member, the linkage portion being no longer than necessary to engage the mounting bracket in the pivotal relation.

* * * * *